US005221913A

United States Patent [19]

Ishizaki et al.

[11] Patent Number: 5,221,913

[45] Date of Patent: Jun. 22, 1993

[54] DIELECTRIC RESONATOR DEVICE WITH THIN PLATE TYPE DIELECTRIC HEAT-RADIATOR

[75] Inventors: Toshio Ishizaki, Kobe; Masami Hatanaka, Higashiosaka, both of Japan

[73] Assignee: Matsushita Electric Industrial Co., Ltd., Osaka, Japan

[21] Appl. No.: 756,584

[22] Filed: Sep. 9, 1991

[30] Foreign Application Priority Data

Sep. 26, 1990 [JP] Japan ..... 2-258022
Sep. 26, 1990 [JP] Japan ..... 2-258023
Feb. 28, 1991 [JP] Japan ..... 3-33998

[51] Int. Cl.[5] ..... H01P 7/10
[52] U.S. Cl. ..... 333/219.1; 333/234
[58] Field of Search ..... 333/202, 219, 219.1, 333/235, 234, 227, 229; 331/68, 96, 107 DP, 117 D

[56] References Cited

U.S. PATENT DOCUMENTS 4,028,643 6/1977 Itoh ..... 333/113
4,335,365 6/1982 Pomé ..... 331/107 DP
4,580,116 4/1986 Ballato ..... 333/234
4,628,283 12/1986 Reynolds ..... 331/68
4,667,172 5/1987 Longshore et al. ..... 333/134
4,922,211 5/1990 Otnemba et al. ..... 333/219.1 X
4,963,841 10/1990 Sparagna ..... 333/219.1 X

FOREIGN PATENT DOCUMENTS 0351840 1/1990 European Pat. Off. .
3928015 3/1990 Fed. Rep. of Germany .
2284200 4/1976 France .
0081304 5/1983 Japan ..... 333/219.1
0112301 6/1985 Japan ..... 331/96
1109802 4/1989 Japan .

OTHER PUBLICATIONS

K. Wakino, et al, "800 MHz band miniaturized channel dropping filter using low loss dielectric resonator", Denshi Tokyo No. 24, pp. 72–75, 1985.

*Primary Examiner*—Robert J. Pascal
*Assistant Examiner*—Seung Ham
*Attorney, Agent, or Firm*—Stevens, Davis, Miller & Mosher

[57] ABSTRACT

A dielectric heat-radiator of a thin plate form is pressed against one side of a dielectric resonator and a dielectric support is bonded to an opposite side of the dielectric resonator. The heat-radiator is supported elastically with nuts and springs by support columns each fixed at one end to a metal baseplate. The resonant frequency is adjusted by processing the electromagnetic energy transmitted through the dielectric heat-radiator. In consequence, heat generated in the dielectric resonator, upon having a high-power high-frequency signal applied thereto, is allowed to propagate efficiently to the dielectric heat-radiator having a high heat conductivity through the wide contact surface between the dielectric resonator and the heat-radiator.

3 Claims, 2 Drawing Sheets

DIELECTRIC RESONATOR DEVICE WITH THIN PLATE TYPE DIELECTRIC HEAT-RADIATOR

BACKGROUND OF THE INVENTION 1. Field of the Invention

This invention relates to a dielectric resonator device used mainly in high-power high-frequency radio equipment.

2. Description of the Prior Art

Heretofore, the dielectric resonator device has been often used in high-frequency radio equipment as a resonator which has a high Q factor not only in the microwave band but also in the UHF band.

A conventional dielectric resonator device is constructed such that a cylindrical dielectric resonator to which a dielectric support is bonded with the use of glass is fixed within a metal case provided with a loop-like electrode loop through which high-frequency signals are received and delivered, by screwing the dielectric support, and an opening of the metal case is closed by a metal cover having a tuning screw so as to shield the device. The dielectric resonator is magnetically combined with the loop-like electrode so as to resonate at a specific frequency determined by the dielectric constant, the shape of the resonator and the type of resonance mode to be used. Adjustment of the resonance frequency is performed by moving the tuning screw to and away from the dielectric resonator. It is possible to reduce the size of the dielectric resonator device by increasing the dielectric constant of the resonator.

On the other hand, it is possible to make the dielectric resonator device operate as a band-pass filter by providing two electrodes which serve as input/output terminals, respectively. The filter of such construction is widely used as the channel filter of the transmitter multiplexer equipped in the mobile radio base station as shown in the literature, for example (K. Wakino, et al., "800 MHz band miniaturized channel dropping filter using low loss dielectric resonator", Denshi Tokyo No. 24, 1985, pp. 72–75).

In the dielectric resonator device, electromagnetic energy for resonation is stored inside the dielectric resonator and in the vicinity thereof. For this reason, when a metal conductor is brought close to the dielectric resonator, high-frequency current flows on the surface of the conductor so as to cause a loss in electromagnetic energy due to resistance, thereby deteriorating the characteristics of the resonator. Therefore, it is necessary to consider that the internal structure of the metal case of the dielectric resonator device is so designed as not to allow any metal to approach the dielectric resonator, in order to prevent a loss in electromagnetic energy.

Further, a part of the electromagnetic energy stored inside and in the vicinity of the dielectric resonator is converted into heat within the dielectric resonator and the dielectric support due to a dielectric loss. The dielectric support is made of a material which has a small dielectric constant and causes less high-frequency loss, and it is designed such that most of the electromagnetic energy is stored in the dielectric resonator which exhibits a large dielectric constant so that the dielectric loss is almost caused in the dielectric resonator.

Heat generated in the dielectric resonator is radiated by way of the following two routes. One of them is to radiate heat from the dielectric support due to heat conduction, and the other one is to radiate heat from the surface of the dielectric resonator through the air within the metal case. However, in addition to the above conditions, there is a certain condition in selecting the material of the dielectric support such that the coefficient of thermal expansion of the material must be identical with that of the dielectric resonator because they are bonded to each other by use of glass. None of the dielectric materials of high heat conductivity which are known at present satisfy these conditions. In consequence, in the dielectric resonator of the conventional structure, the amount of heat radiated from the dielectric support was very small. Further, in such a case that the dielectric resonator is reduced in size while the dielectric constant or working frequency thereof is increased, it becomes difficult to radiate heat from the surface of the dielectric resonator since the surface area thereof is small.

In the dielectric resonator device of such construction, when a high-power high-frequency signal is fed thereto, the temperature of the dielectric resonator rises to cause problems including an increase in high-frequency loss and a drift of resonance frequency of the dielectric resonator.

In order to solve the above-mentioned problems, there has hitherto been proposed a method in which bar dielectrics are inserted into a drum dielectric resonator from above and below and fixed thereto so as to radiate heat as disclosed in Japanese patent Unexamined publication No. 1-109802. This method, however, has problems wherein (1) dimensional accuracy of the drum dielectric resonator and the bar dielectrics and the roughness of the contact surface make it difficult to reduce the contact thermal resistance, (2) it is impossible to extend the frequency variable range since the tuning mechanism and the resonator cannot be opposed to each other from the viewpoint of structure, and (3) it is not applicable to the cylindrical dielectric resonator.

SUMMARY OF THE INVENTION

An object of the present invention is to provide a small type dielectric resonator device which can be used at a high power and radiate heat with a high degree of efficiency from a dielectric resonator without deteriorating high-frequency characteristics of the resonator device when it receives a high-power high-frequency signal.

To this end, according to the present invention, there is provided a dielectric resonator device in which a dielectric radiator of a thin plate form is pressed against a dielectric resonator on the side remote from a surface to which a dielectric support is bonded. A heat-radiator is supported elastically with nuts and springs to support columns which are fixed to a metal baseplate at one end thereof. Further the frequency is adjusted by processing the electromagnetic energy transmitted through the dielectric heat-radiator.

With this arrangement, heat generated from the dielectric resonator propagates through the wide contact surface to the dielectric heat-radiator of high heat conductivity, resulting in that a temperature rise of the dielectric resonator can be restrained.

DESCRIPTION OF THE PREFERRED EMBODIMENTS

Figure 1:
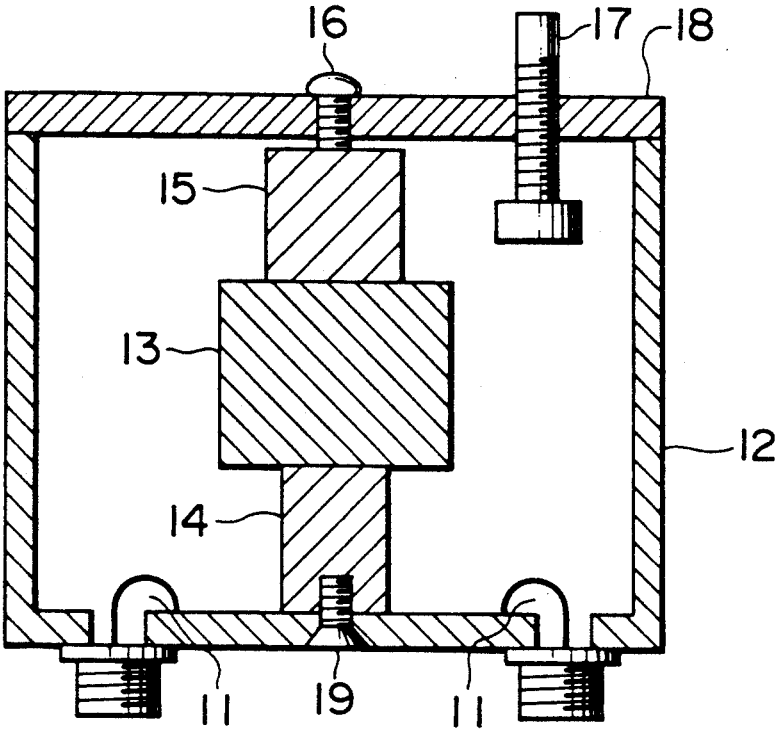
FIG. 1 is a sectional view illustrating a dielectric resonator device according to a first embodiment of the present invention.

FIG. 1 is a sectional view of a dielectric resonator device in a first embodiment of the present invention.

Referring to FIG. 1 loop-like electrodes 11 through which a high-frequency signal is received and delivered are disposed within a metal case (of cylindrical form) 12, and a dielectric resonator (of cylindrical form) 13 is bonded to a dielectric support 14) by use of glass and, then, the dielectric support 14 is fixed within the metal case 12 by fastening a screw 19. A columnar dielectric heat-radiator 15 is pressed against a surface of the dielectric resonator 13 on the side remote from the surface to which the dielectric support 14 is bonded and, then, fixed by means of a screw 16 or the like. An opening in the metal case 12 is closed by a metal cover 18 attached with a tuning screw 17 so as to shield the inside of the case in its entirety.

Heat generated as a result of a dielectric loss of the dielectric resonator 13 upon delivery of a high-power high-frequency signal is radiated through the contact surface between the dielectric resonator 13 and the dielectric heat-radiator 15 due to heat conduction. With the above construction, it is easy to obtain a large area of the contact surface between the dielectric resonator 13 and the dielectric heat-radiator 15 as well as to reduce the thermal contact resistance by polishing the contact surfaces. Since the force by which the dielectric heat-radiator 15 is pressed against the dielectric resonator 13 is not applied as a tensile force but as a pressing force to the glass-bonded portion between the dielectric resonator 13 and the dielectric support 14, there is no possibility of damage of the glass-bonded portion even if the pressing force is increased. In consequence, it is possible to stably maintain a small thermal contact resistance between the dielectric resonator 13 and the dielectric heat-radiator 15 and the mechanical strength can be increased as well.

Figure 2:
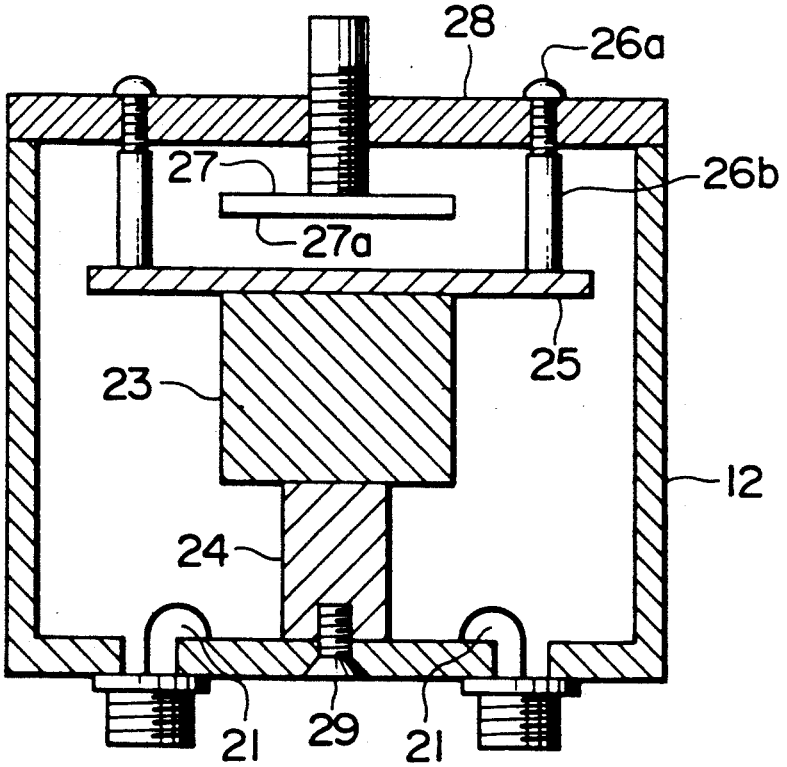
FIG. 2 is a sectional view illustrating a dielectric resonator device according to a second embodiment of the invention.

FIG. 2 is a sectional view illustrating a dielectric resonator device in a second embodiment of the present invention.

In FIG. 2, loop-like electrodes 21 through which a high-frequency signal is received and delivered are disposed within the metal case (of cylindrical form) 12, and a columnar dielectric resonator 23 is bonded at one end surface thereof to a columnar dielectric support 24 by use of glass and, then the dielectric support 24 is fixed within the metal case 12 by fastening a screw 29. A dielectric heat-radiator 25 of a thin plate form (or a disc form) is pressed against the other end surface of the dielectric resonator 23 on the side remote from the surface to which the dielectric support 24 is bonded and, then, fixed by means of screws **26*a* and attachment 26*b*. An opening in the metal case 12 is closed by a metal cover 28 attached thereto with a tuning screw 27 having an end plate (disc-shaped) 27*a*, so as to shield the inside of the case in its entirety. The tuning screw 27 is arranged so as to be opposed to the other surface of the dielectric resonator 23 which is caused to contact the dielectric heat-radiator 25, with the latter intervening between screw 27 and the resonator, in order to act upon the electromagnetic energy transmitted through the dielectric thin plate heat-radiator 25** so that the resonance frequency is adjusted.

In this embodiment, since the frequency is adjusted by acting upon the electromagnetic energy transmitted through the dielectric thin plate heat-radiator 25, it is possible to obtain a large area through which the plate end **27*a* of the tuning screw 27 faces the dielectric resonator 23**. It is therefore possible to enlarge the frequency variable range in comparison with the first embodiment.

The fundamental principle of the frequency adjusting method of this embodiment, that is, the idea of processing the electromagnetic energy transmitted through the dielectric plate has been already disclosed in U.S. Pat. No. 4,628,283 as a method of shielding an oscillator using a dielectric resonator. However, the method of fixing the dielectric resonator has offered a critical problem in the high-power dielectric resonator device, which is solved by the present invention, and the above-mentioned U.S. Patent neither discloses nor suggests the method of fixing the dielectric resonator which is available at a high electric power. For example, a method of bonding the dielectric resonator and the dielectric plate to each other by a resinous adhesive cannot be used because the resin of the adhesive is deteriorated by the high-frequency signal, and therefore, the above mentioned U.S. Patent cannot solve this problem. In the present invention, the above-described principle is applied to the original fixing method that the dielectric plate heat-radiator is pressed against a surface of the dielectric resonator on the side remote from the surface to which the dielectric support is bonded.

Further, in the present embodiment, since the dielectric heat-radiator which is to be pressed against the dielectric resonator is formed in the shape of a thin plate and hence has a small volume, a part of the electromagnetic energy expected to be stored in the dielectric resonator, that is, the electromagnetic energy expected to exist within the dielectric heat radiator, can be remarkably reduced in capacity as compared with the case of the first embodiment. As a result, a loss of electromagnetic energy due to a dielectric loss through the dielectric heat-radiator can be reduced and, at the same time, the difference between the resonance frequency obtained when the dielectric resonator is used alone and the resonance frequency obtained when the dielectric resonator is used in contact with the dielectric heat-radiator as well as the difference between the temperature coefficients of the resonance frequencies of the respective cases can be reduced. As a result, it is possible to facilitate the design of the dielectric resonator.

In addition, although the dielectric heat radiator is decreased in size since it is formed in the shape of the plate, the area of the contact surface which is one of factors determining the thermal contact resistance between the dielectric heat-radiator and the dielectric resonator remains unchanged, and therefore, the radiation characteristic is not deteriorated. In consequence, the thickness of the dielectric heat-radiator can be reduced so far as the thermal resistivity does not become a problem.

Figure 3:
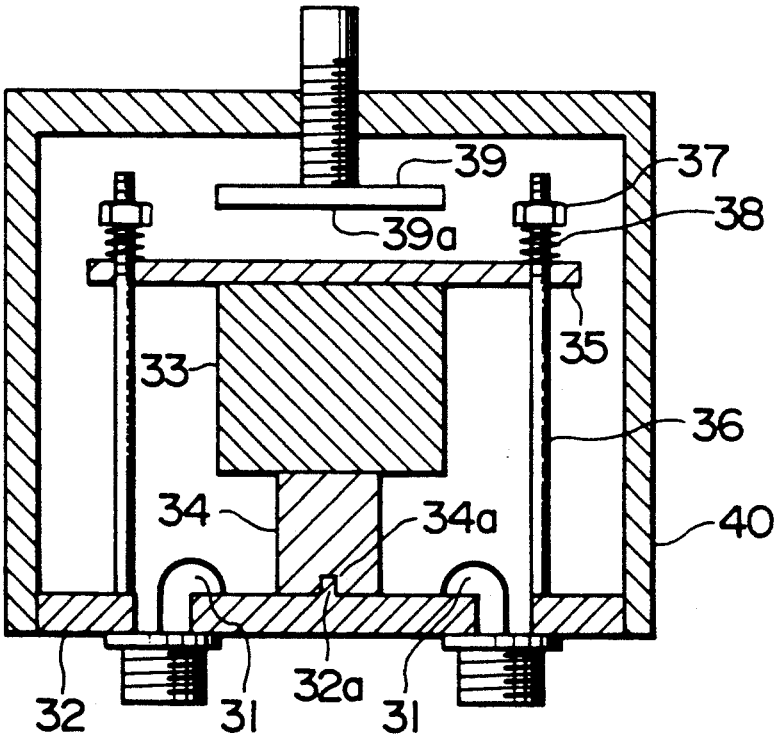
FIG. 3 is a sectional view illustrating a dielectric resonator device according to a third embodiment of the invention.

FIG. 3 is a sectional view of a dielectric resonator device according to a third embodiment of the present invention.

Referring to FIG. 3, a loop-like electrode 31 through which a high-frequency signal is transmitted is attached to a metal baseplate 32, and a dielectric resonator (of cylindrical form) 33 is bonded at one end surface thereof to a dielectric support 34 by use of glass and, then, the dielectric support 34 is set on the metal baseplate 32 with a recess 34*a* thereof being fitted on a positioning protrusion 32*a* formed on the metal baseplate 32. A dielectric heat-radiator 35 of a thin plate form (or disc form) is pressed the other end surface of the dielectric resonator 33 on the side remote from the surface to which the dielectric support 34 is bonded. The dielectric heat-radiator 35 is fixed to support columns 36 by means of nuts and springs 38, one end of each of support columns 36 being fixed to the metal baseplate 32. A metal case (of cylindrical form) 40 attached with a tuning screw 39 having a plate (disc-shaped) end 39*a* is mounted on the metal baseplate 32 so as to cover and shield the inside of the case in its entirety. The tuning screw 39 is so arranged that the plate end 39*a* is opposed to the other end surface of the dielectric resonator 33, with heat-radiator 35 intervening therebetween so as to act upon the frequency by processing the electromagnetic energy transmitted through the dielectric thin plate heat-radiator 35 in order to adjust the resonance frequency. The result of experiments shows that the dielectric thin plate heat-radiator 35 is preferably made of alumina, magnesia and the like.

In the second embodiment, although the difference between the thermal expansion of the dielectric resonator and the dielectric support and the thermal expansion of the support columns is absorbed through the deflection of the dielectric heat radiator, the strength thereof is not high. However in this third embodiment, since the difference in thermal expansion is absorbed by using the springs 38, the dielectric heat-radiator can be completely prevented from being damaged.

Further, according to this embodiment, since attachment of the dielectric heat-radiator can be carried out in such a state that the metal case is removed, it is possible to eliminate defects during manufacture visibly confirming the state of contact between the dielectric resonator and the dielectric heat-radiator.

What is claimed is:

1. A dielectric resonator device comprising:

a metal case provided with an electrode through which a high-frequency signal is transmitted;

a dielectric support fixed to said metal case;

a dielectric resonator having one end surface bonded to said dielectric support;

a dielectric heat-radiator, formed of a thin plate, pressed against the other end surface of said dielectric resonator on a side thereof remote from said one end surface to which said dielectric support is bonded; and a metal cover supporting a tuning member and serving to close an opening of said metal case, said tuning member being disposed opposite to said other end surface of said dielectric resonator with said heat-radiator interposed therebetween so as to act upon electromagnetic energy transmitted through said dielectric heat-radiator in order to adjust a resonant frequency of said resonator device.

2. A dielectric resonator device comprising:

a metal baseplate provided with an electrode through which a high-frequency signal enters and leaves;

a dielectric support disposed on said metal baseplate;

a dielectric resonator having one end surface bonded to said dielectric support;

a dielectric heat-radiator, formed of a thin plate, pressed against the other end surface of said dielectric resonator on a side thereof remote from said one end surface to which said dielectric support is bonded, said dielectric heat-radiator being supported resiliently by a spring assembly on support columns each fixed at one end to said metal baseplate; and a metal case supporting a tuning member and mounted on said metal baseplate so as to cover the dielectric resonator in its entirety, said tuning member being disposed opposite to said other end surface of said dielectric resonator so as to act upon electromagnetic energy transmitted through said dielectric heat-radiator in order to adjust a resonant frequency of said resonator device.

3. A dielectric resonator device according to claim 2, wherein the dielectric heat-radiator is made of a material selected from a group consisting of alumina and magnesia.

* * * * *